US007172355B2

(12) United States Patent
Tani

(10) Patent No.: US 7,172,355 B2
(45) Date of Patent: Feb. 6, 2007

(54) CARTRIDGE TYPE FEEDING CONTAINER

(75) Inventor: Yoshikazu Tani, Oji (JP)

(73) Assignee: Tokiwa Corporation, Nakatsugawa (JP)

( * ) Notice: Subject to any disclaimer, the term of this patent is extended or adjusted under 35 U.S.C. 154(b) by 118 days.

(21) Appl. No.: 11/038,151

(22) Filed: Jan. 21, 2005

(65) Prior Publication Data

US 2005/0175393 A1 Aug. 11, 2005

(30) Foreign Application Priority Data

Feb. 5, 2004 (CN) ..... 200420003387

(51) Int. Cl.
*B43K 27/02* (2006.01)

(52) U.S. Cl. ..... 401/19; 401/68

(58) Field of Classification Search ..... 401/60, 401/68, 75, 87, 92, 98, 116
See application file for complete search history.

(56) References Cited

U.S. PATENT DOCUMENTS 6,345,922 B2 * 2/2002 Tani ..... 401/32
6,827,516 B2 * 12/2004 Gutberlet ..... 401/25
6,866,438 B2 * 3/2005 Bauer et al. ..... 401/194

FOREIGN PATENT DOCUMENTS

JP 11-056460 3/1999
JP 2001-252134 9/2001

* cited by examiner

*Primary Examiner*—Huyen Le
(74) *Attorney, Agent, or Firm*—Bacon & Thomas, PLLC

(57) ABSTRACT

To prevent the accidental separation of a lid body from a main body, a cartridge type feeding container has a tubular main body (1) receiving a cosmetic material (81), a lid body (2) with an applicator (21) including a rearward protruding applying member (21*a*) and being inserted into the main body, a cartridge (3) which receives a core chuck (31*a*) slidably therein and has its rear side inserted into the lid body, a feeding and drawing mechanism (4) for the core chuck, fist stage projections (51) provided on the main body or the applicator, second stage projections (52) provided on the main body or the applicator adjacently to the first stage projections, the projections (5) being V-shaped and having top and inclined portions, and a locking projection passing between the adjacent projections (5) provided on a surface where the projections (5) are not provided.

3 Claims, 9 Drawing Sheets

CARTRIDGE TYPE FEEDING CONTAINER

TECHNICAL FIELD

The present invention relates to a cartridge type feeding container employed for the purpose of appropriately feeding a stick-shaped cosmetic material inserted to a cartridge so as to use.

BACKGROUND ART

As a conventional cartridge type feeding container, there has been known a structure provided with a tubular main body which is open, for example, to a front side, and receives a cosmetic material in an inner portion, a lid body which is provided with an applicator having an applying member in a rear end portion so as to protrude toward a rear side and is attached to the main body in such a manner as to insert the applicator into the main body, and is open toward a front side, a cartridge in which a core chuck for holding the stick-shaped cosmetic material is received so as to be slidable in a longitudinal direction and which is connected to the lid body in such a manner as to insert a rear side into the lid body, and a feeding and drawing mechanism for feeding the core chuck to a front end side of the cartridge and drawing the core chuck to a rear end side.

In this case, the applicator provided in the lid body can be pressed to the cosmetic material received within the main body at a time when the lid body is attached to the main body, whereby it is possible to attach the cosmetic material to the applying member.

In the conventional cartridge type feeding container, while it is possible to attach the cosmetic material to the applying member only by attaching the lid body to the main body, a position of the applying member with respect to the lid body is not changed, however, a position of a front side surface of the cosmetic material with respect to the main body moves backward inevitably in accordance with passage of use hour. Accordingly, in the case that the use time has considerably passed, the pressing force of the applying member to the cosmetic material becomes insufficient, and it is hard to securely attach a sufficient amount of cosmetic material to the applying member.

Further, in the conventional cartridge type feeding container, in the case of using the cosmetic material attached to the applying member, it is necessary to detach the lid body from the main body. However, at that time, if the lid body or the main body is slipped off a user's hand by accident, the lid body or the main body jumps out of the main body or the lid body to fall down, so that there is generated a case that dirt is attached to the applying member, the cosmetic material received within the main body is scattered on a floor, or the lid body or the main body is broken.

SUMMARY OF THE INVENTION

Accordingly, a first object of the present invention is to provide a cartridge type feeding container which can securely attach a sufficient amount of cosmetic material to an applying member only by attaching a lid body to a main body irrespective of a consumption condition.

Further, a second object of the present invention is to provide a cartridge type feeding container which can previously prevent a situation that the lid body or the main body jumps out of the main body or the lid body to fall down, even if the lid body or the main body is slipped off a user's hand by accident, in order to prevent the attachment of dirt to the applying member, the scattering of the cosmetic material to a floor or the like, and the breakage of the lid body or the main body from being generated.

In order to achieve the object mentioned above, in accordance with a first aspect of the present invention, there is provided a cartridge type feeding container comprising:

a tubular main body which is open to a front side, and receives a cosmetic material in an inner portion;

a lid body which is provided with an applicator having an applying member so as to protrude toward a rear side and is attached to the main body in such a manner as to insert the applicator into the main body, and is open toward a front side;

a cartridge in which a core chuck for holding the stick-shaped cosmetic material is received so as to be slidable in a longitudinal direction and which is connected to the lid body in such a manner as to insert a rear side into the lid body; and a feeding and drawing mechanism for feeding the core chuck to a front end side of the cartridge and drawing the core chuck to a rear end side, wherein the main body is provided with an outer tube which is open toward a front side, an inner tube which is provided within the outer tube so as to be slidable in a longitudinal direction, has the cosmetic material received in an inner portion, and is open toward a front side, and an elastic body which is received within the outer tube, and is provided for energizing the inner tube toward a front side, and the inner tube is energized toward the front side by the elastic body, whereby the cosmetic material received within the inner tube is pressed to the applicator of the lid body attached to the main body.

In accordance with the cartridge type feeding container mentioned above, since the main body is provided with the outer tube, the inner tube in which the cosmetic material is received, and the elastic body which energizes the inner tube to the front side, it is possible to sufficiently obtain the pressing force of the applying member to the cosmetic material even in the case that the use time has significantly passed.

Therefore, in accordance with this structure, it is possible to securely attach a sufficient amount of cosmetic material to the applying member only by attaching the lid body to the main body, irrespective of the consumption condition.

Further, in accordance with the other aspect of the present invention, there is provided a cartridge type feeding container comprising:

a tubular main body which is open to a front side, and receives a cosmetic material in an inner portion;

a lid body which is provided with an applicator having an applying member in a rear end portion so as to protrude toward a rear side and is attached to the main body in such a manner as to insert the applicator into the main body, and is open toward a front side;

a cartridge in which a core chuck for holding the stick-shaped cosmetic material is received so as to be slidable in a longitudinal direction and which is connected to the lid body in such a manner as to insert a rear side into the lid body; and a feeding and drawing mechanism for feeding the core chuck to a front end side of the cartridge and drawing the core chuck to a rear end side, wherein a plurality of first stage projections are provided on an inner peripheral surface of the main body or an outer peripheral surface of the applicator along a peripheral direction, a plurality of second stage projections are provided along the peripheral direction at positions which are on the inner peripheral surface of the main body or the outer peripheral surface of the applicator, are adjacent to rear sides of the first stage projections and correspond to gaps between the adjacent first stage projections, each of the first stage and second stage projections is formed in an approximately V shape and has a top portion directed to a front side and an inclined portion inclined toward right and left rear sides respectively from the top portion, and a locking projection passing through a gap between the respective adjacent projections in a lateral direction at a time when the lid body is attached to the main body is provided in the outer peripheral surface of the applicator or the inner peripheral surface of the main body where the respective projections are not provided.

In accordance with the cartridge type feeding container mentioned above, since the first stage projections and the second stage projections are provided on the inner peripheral surface of the main body or the outer peripheral surface of the applicator, and the locking projection is provided in the outer peripheral surface of the applicator or the inner peripheral surface of the main body, it is possible to prevent the situation that the lid body or the main body jumps out of the main body or the lid body to fall down, even if the lid body or the main body is slipped off a user's hand by accident.

Therefore, in accordance with this structure, it is possible to prevent the attachment of dirt to the applying member, the scattering of the cosmetic material to a floor or the like, and the breakage of the lid body or the main body from being generated.

In the technical means mentioned above, in the sight of making it possible to securely prevent the situation that the lid body or the main body jumps out from the main body or the lid body to fall down also in the case of having a mechanism that the lid body or the main body easily jumps out from the main body or the like body in spite of the lid body or the main body being held by the user's hand, thereby securing an effect of preventing the attachment of dirt to the applying member, the scattering of the cosmetic material to the floor or the like, the breakage of the lid body or the main body, and the like, it is preferable that the main body is provided with an outer tube which is open toward a front side, an inner tube which is provided within the outer tube so as to be slidable in a longitudinal direction, has the cosmetic material received in an inner portion, and is open toward a front side, and an elastic body which is received within the outer tube, and is provided for energizing the inner tube toward a front side, and the inner tube is energized toward the front side by the elastic body, whereby the cosmetic material received within the inner tube is pressed to the applicator of the lid body attached to the main body.

Further, in the sight of further adding a function capable of buffering an impact applied by an external force generated by the drop to the floor or the like, thereby making it possible to obtain an effect of preventing the falling out of the cartridge from the lid body, the breakage of the stick-shaped cosmetic material, the falling out of the stick-shaped cosmetic material from the core chuck and the like, it is preferable that an intermediate device corresponding to a tubular elastic body buffering the impact applied in a direction in which the cartridge protrudes out is interposed between the cartridge and the lid body.

Further, in the sight of preventing an unexpected situation that the external force impact buffering function is not sufficiently achieved from occurring as much as possible, thereby securing the effect of preventing the falling out of the cartridge from the lid body, the breakage of the stick-shaped cosmetic material, the falling out of the stick-shaped cosmetic from the core chuck and the like, it is preferable that the intermediate device is made of resin, and has a slit which is spirally notched on an outer peripheral wall.

Further, in the sight of arranging a torque limiter with respect to a synchronous rotation of the main body and the intermediate body, thereby avoiding a situation that the container is damaged by an excessive torque, it is preferable that the core chuck is formed in a front end portion of a screw rod which has a male screw formed in an outer portion, and is received within the cartridge, the cartridge is constituted by a sleeve corresponding to a front side in which a support portion supporting the core chuck so as not to rotate and to be slidable is formed in an inner portion, and an intermediate body corresponding to a rear side in which a female thread engaging with the male screw is formed in an inner portion, a plurality of first vertical ribs each protruding to an outer side and extending in a longitudinal direction are formed in an outer periphery of a rear end portion of the intermediate body along a peripheral direction, a plurality of second vertical ribs each protruding to an inner side and extending in the longitudinal direction are formed in an inner periphery of an opening portion of the lid body along the peripheral direction, the cartridge is connected to the lid body such as to engage the first vertical rib and the second vertical rib with each other, thereby allowing the main body and the intermediate body to synchronously rotate, the first vertical rib or the second vertical rib has an inclined surface, in which an end portion is inclined toward a front left side or a front right side and with which end portions of the adjacent second vertical ribs or first vertical ribs are brought into contact at a time of the synchronous rotation, and the intermediate device is contracted at a time when an excessive torque is applied to the screw rod, whereby the second vertical rib or the first vertical rib brought into contact with the inclined surface climbs over the first vertical rib or the second rib having the inclined surface.

In accordance with the cartridge type feeding container on the basis of the present invention, it is possible to securely attach a sufficient amount of cosmetic material to the applying member only by attaching the lid body to the main body, irrespective of the consumption condition. Further, even if the lid body or the main body is slipped off a user's hand by accident, it is possible to prevent the situation that the lid body or the main body jumps out from the main body or the lid body to fall down, and it is possible to obtain an effect of preventing the attachment of dirt to the applying member, the scattering of the cosmetic material to the floor or the like, and the breakage of the lid body or the main body.

BEST MODE FOR CARRYING OUT THE INVENTION

A description will be in detail given below of an embodiment in accordance with the present invention with reference to the accompanying drawings.

In this case, a description will be given of a case that first stage projections and second stage projections are provided in an inner peripheral surface of a main body, and a locking projection is provided in an outer peripheral surface of an applicator, however, the structure is not limited to this, but the following description can be applied to a case that the first stage projections and the second stage projections are provided in the outer peripheral surface of the applicator, and the locking projection is provided in the inner peripheral surface of the main body.

Figure 1:
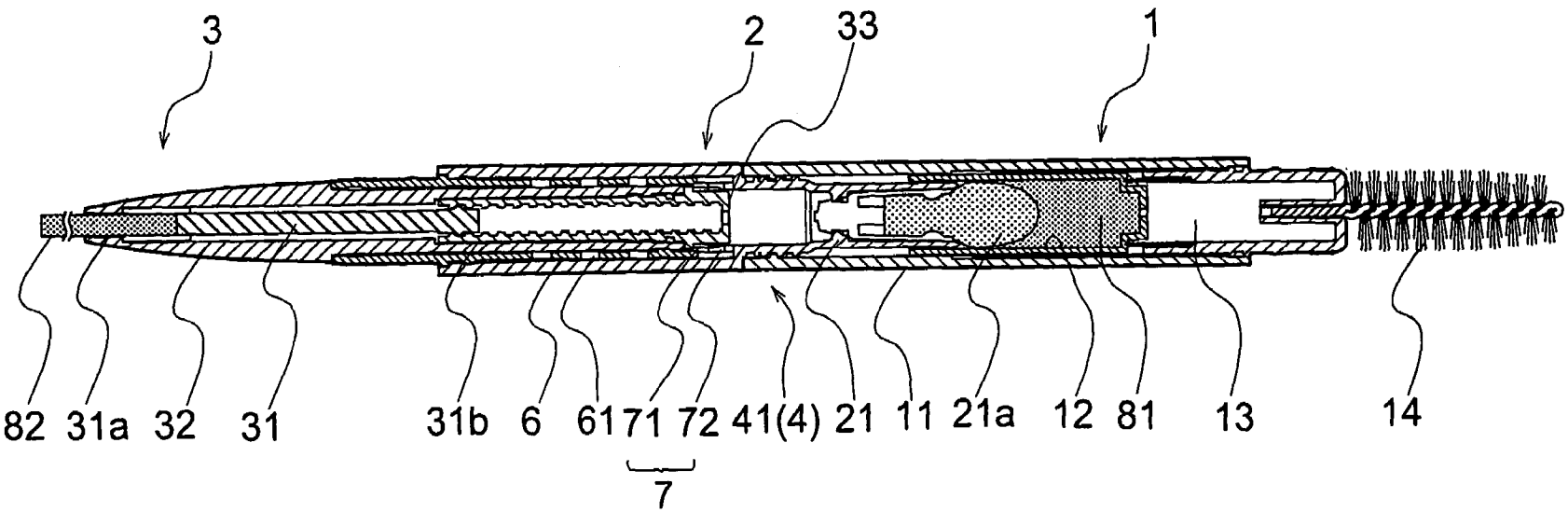
FIG. 1 is a vertical cross sectional view showing an entire structure of a cartridge type feeding container in accordance with one embodiment of the present invention.
Figure 2:
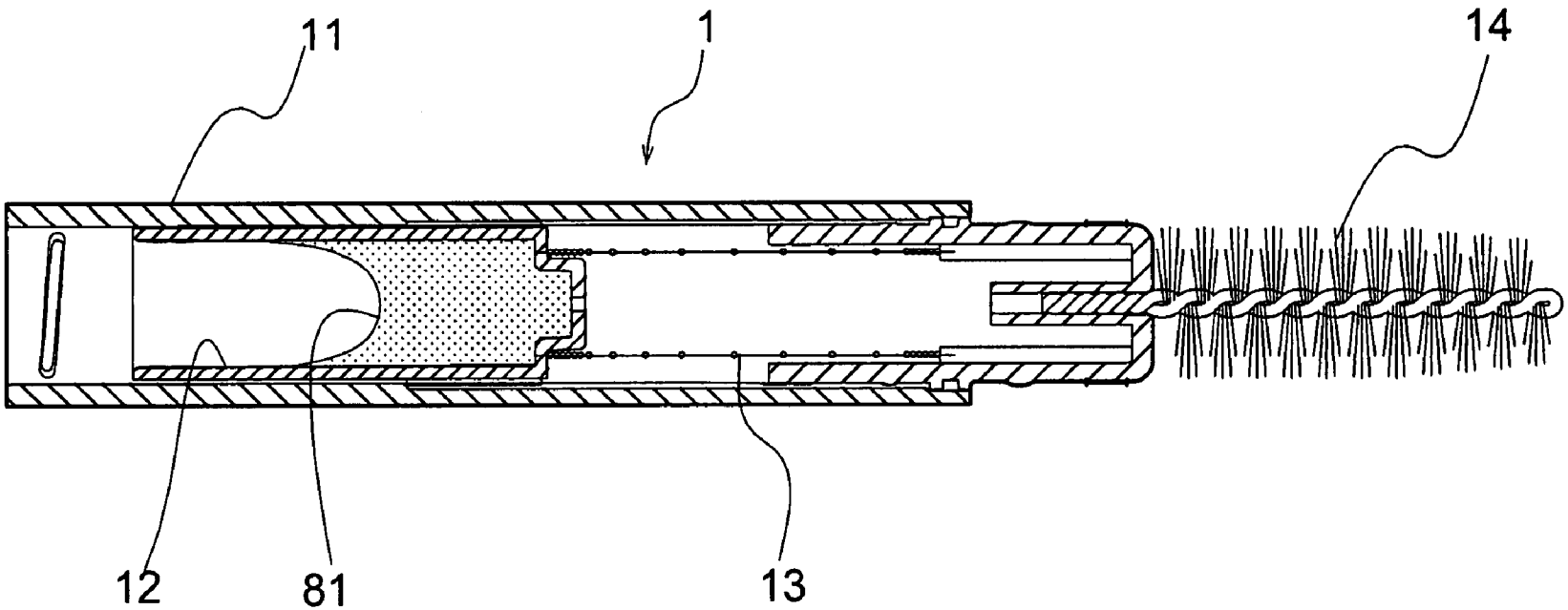
FIG. 2 is a vertical cross sectional view showing a main body corresponding to a constituting element of the cartridge type feeding container in accordance with one embodiment of the present invention.
Figure 3:
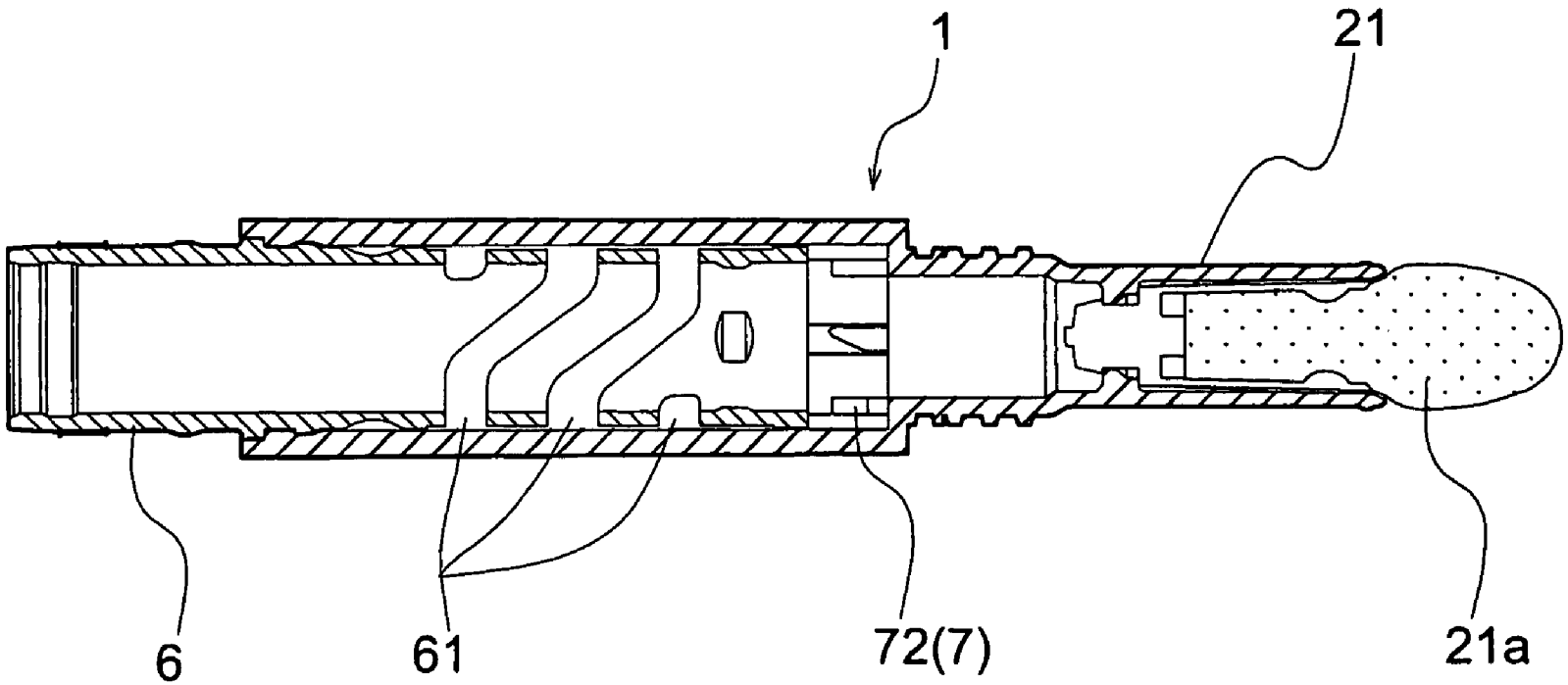
FIG. 3 is a vertical cross sectional view showing a lid body corresponding to a constituting element of the cartridge type feeding container in accordance with one embodiment of the present invention.
Figure 4:
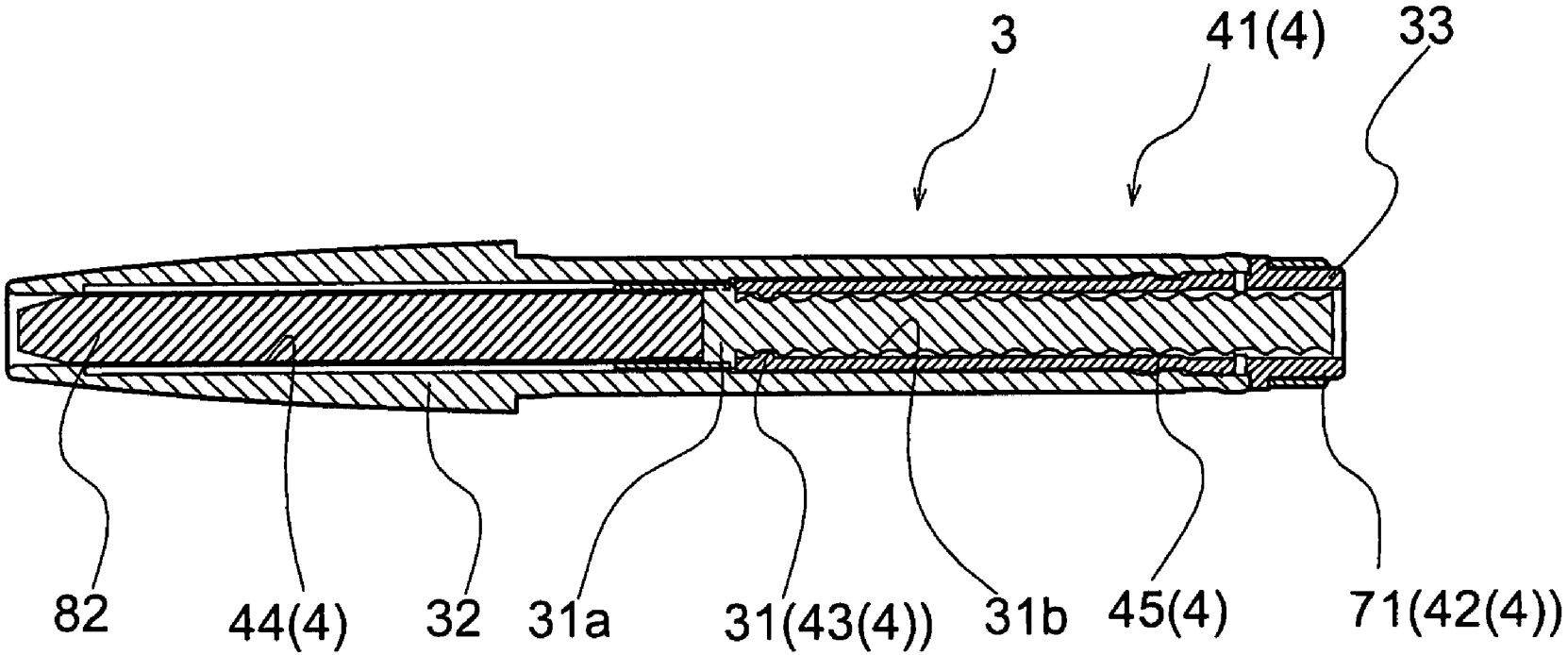
FIG. 4 is a vertical cross sectional view showing a cartridge corresponding to a constituting element of the cartridge type feeding container in accordance with one embodiment of the present invention.
Figure 5:
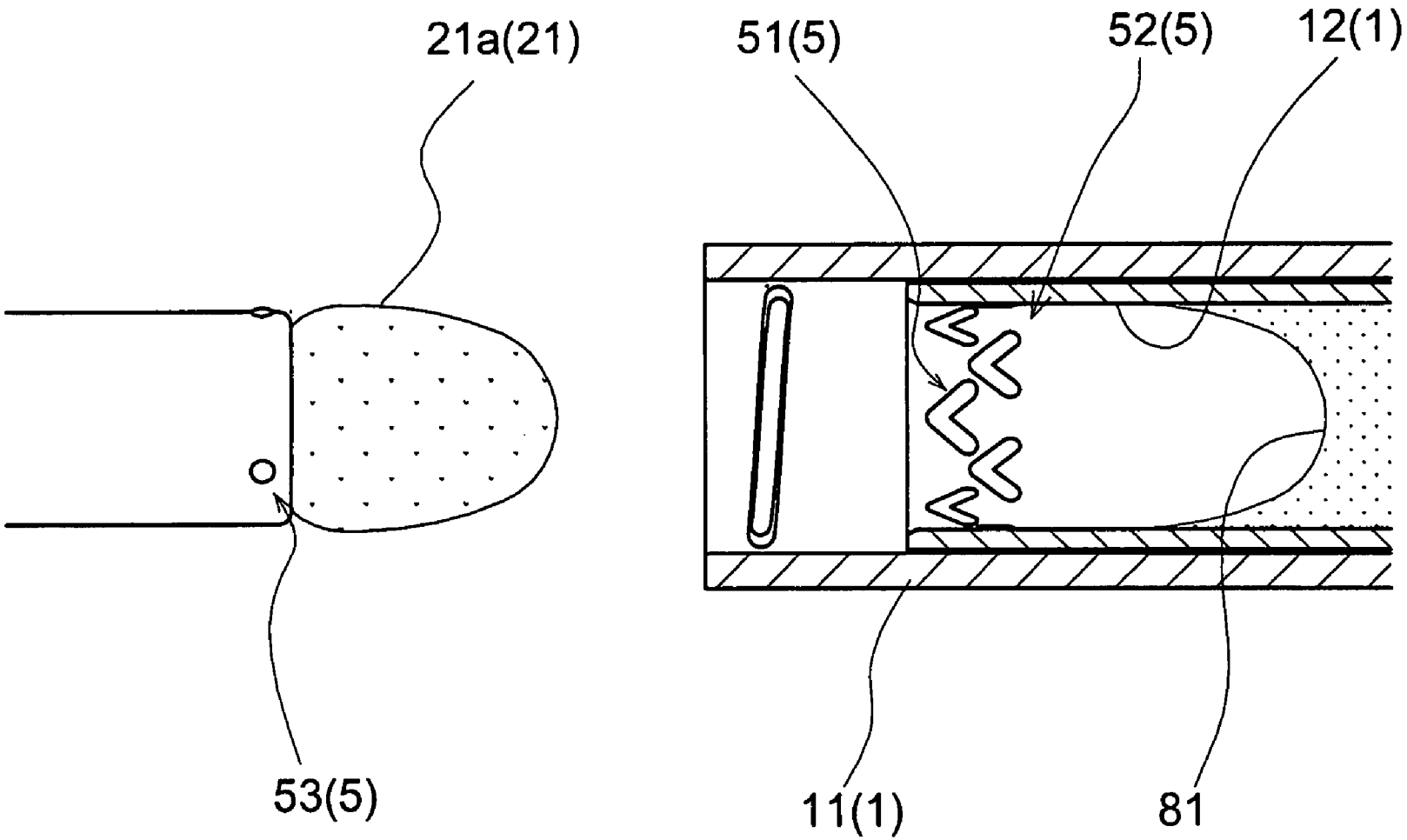
FIG. 5 is a vertical cross sectional view showing a projection (an entire structure) corresponding to a constituting element of the cartridge type feeding container in accordance with one embodiment of the present invention.
Figure 6:
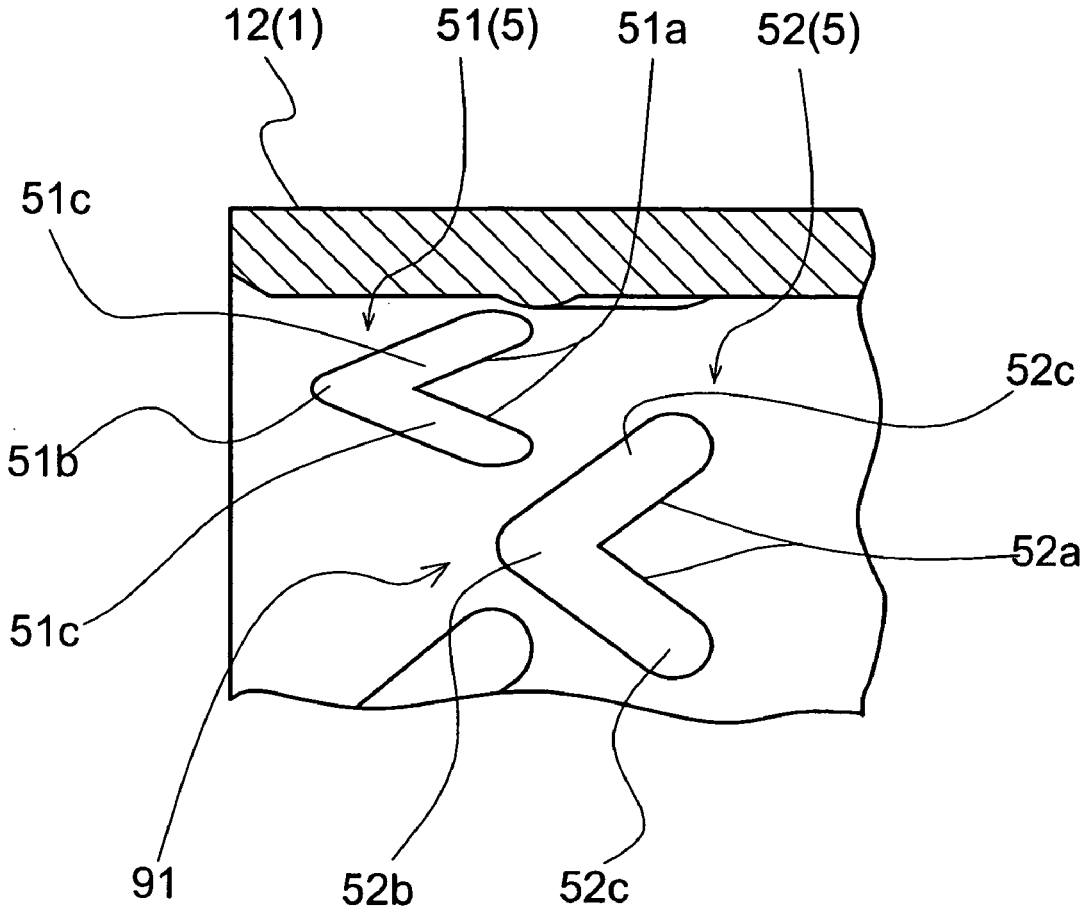
FIG. 6 is a vertical cross sectional view showing the projection (a partial structure) corresponding to a constituting element of the cartridge type feeding container in accordance with one embodiment of the present invention.
Figure 7:
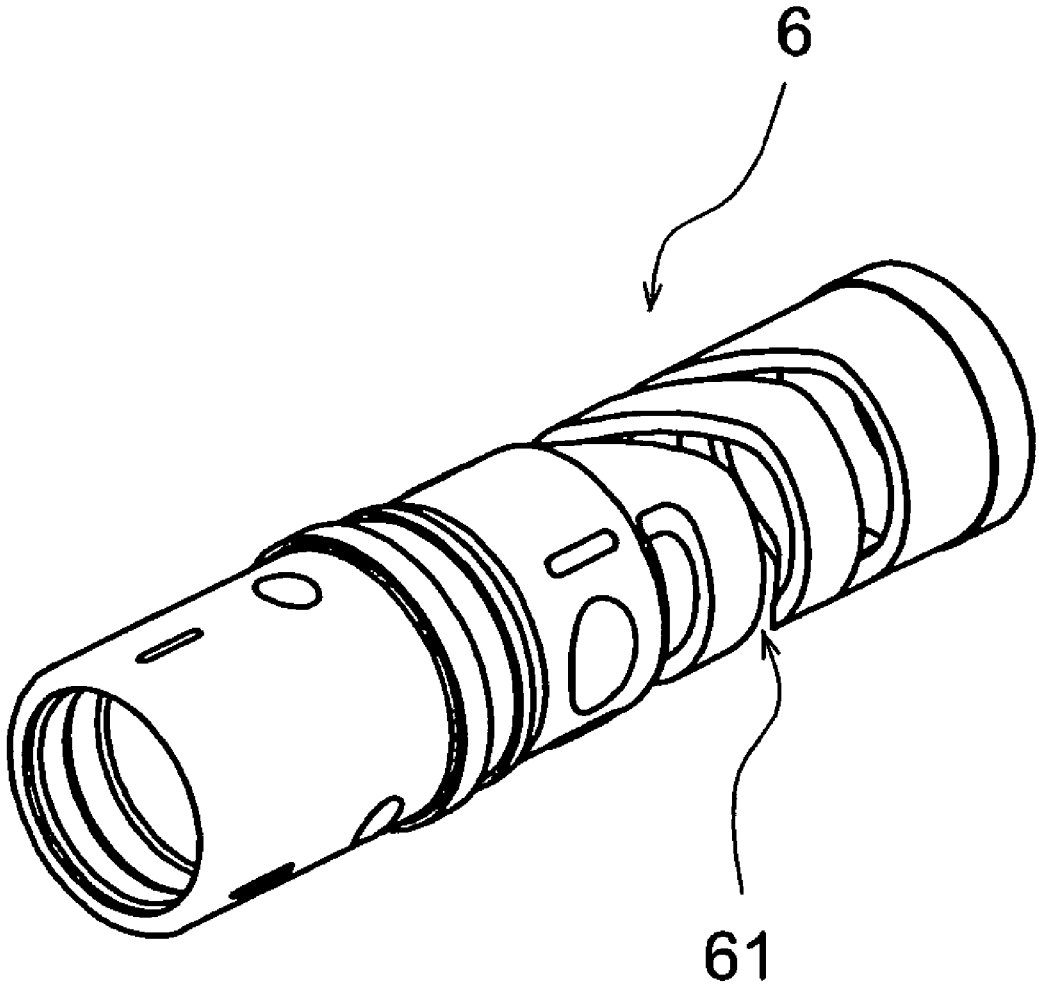
FIG. 7 is a perspective view showing an intermediate device corresponding to a constituting element of the cartridge type feeding container in accordance with one embodiment of the present invention.
Figure 8:
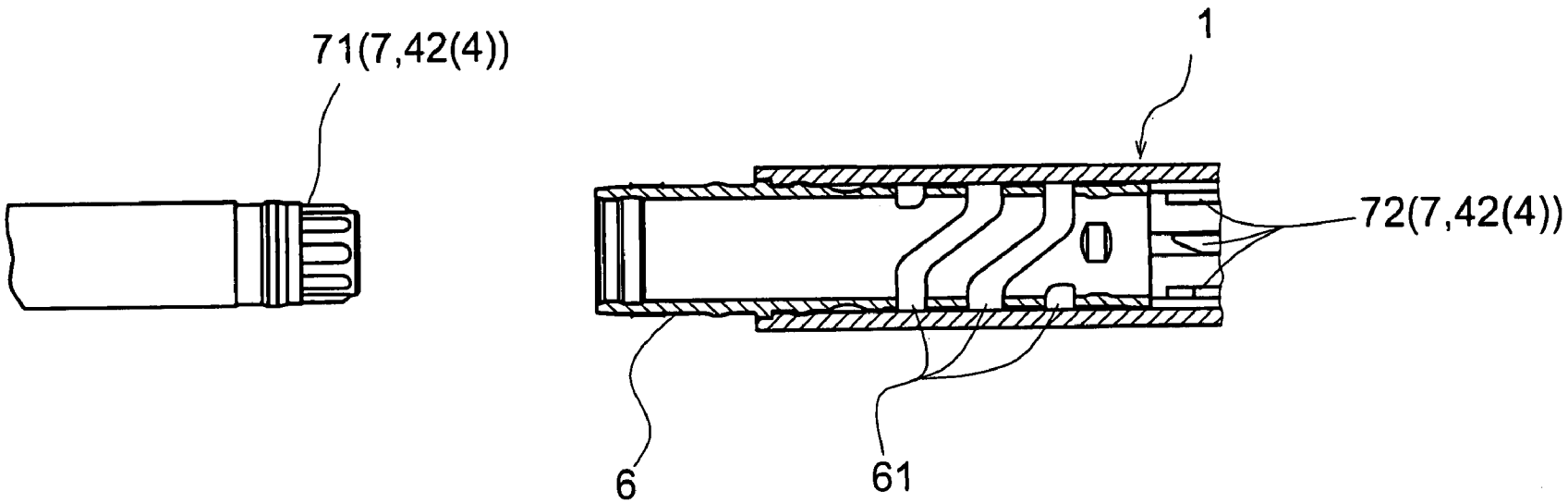
FIG. 8 is a vertical cross sectional view showing a vertical rib corresponding to a constituting element of the cartridge type feeding container in accordance with one embodiment of the present invention.
Figure 9:
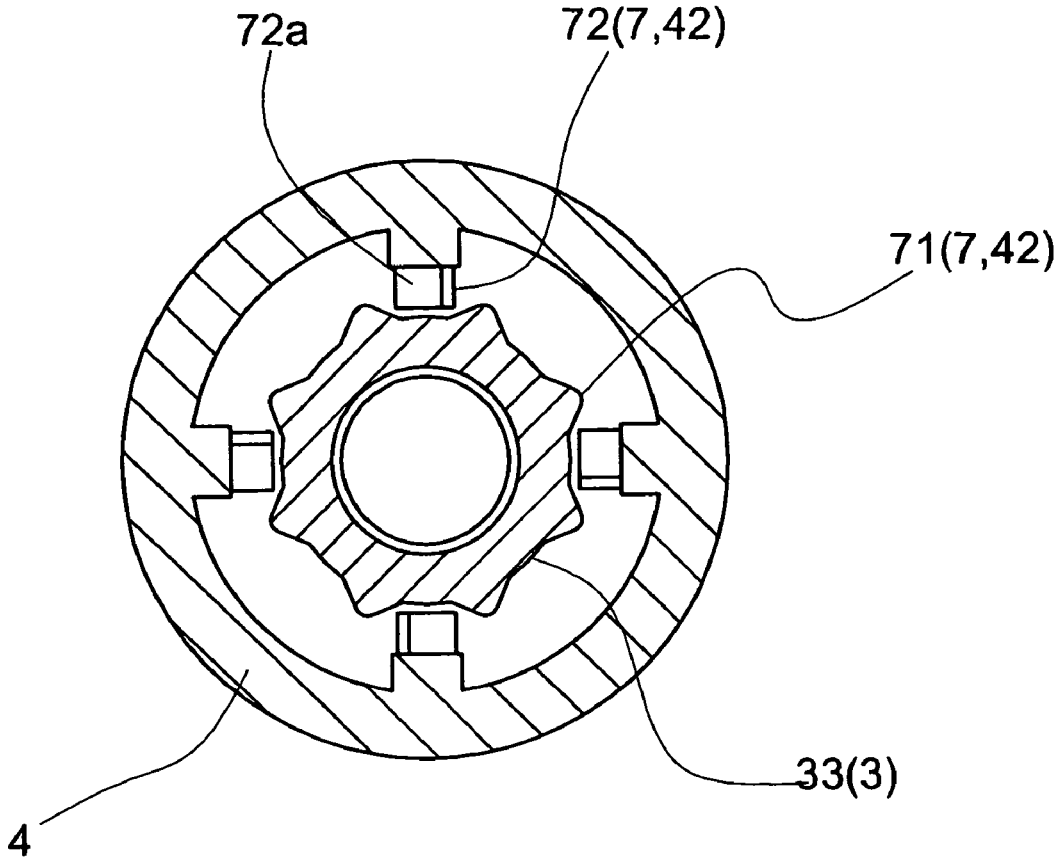
FIG. 9 is a horizontal cross sectional view showing the vertical rib corresponding to a constituting element of the cartridge type feeding container in accordance with one embodiment of the present invention.

FIG. 1 is a vertical cross sectional view showing an entire structure of a cartridge type feeding container in accordance with an embodiment of the present invention, FIG. 2 is a vertical cross sectional view showing a main body corresponding to a constituting element of the cartridge type feeding container, FIG. 3 is a vertical cross sectional view showing a lid body corresponding to a constituting element of the cartridge type feeding container, FIG. 4 is a vertical cross sectional view showing a cartridge corresponding to a constituting element of the cartridge type feeding container, FIG. 5 is a vertical cross sectional view showing a projection (an entire structure) corresponding to a constituting element of the cartridge type feeding container, FIG. 6 is a vertical cross sectional view showing the projection (a partial structure) corresponding to a constituting element of the cartridge type feeding container, FIG. 7 is a perspective view showing an intermediate device corresponding to a constituting element of the cartridge type feeding container, FIG. 8 is a vertical cross sectional view showing a vertical rib corresponding to a constituting element of the cartridge type feeding container, and FIG. 9 is a horizontal cross sectional view showing the vertical rib corresponding to a constituting element of the cartridge type feeding container.

In these views, a display of a cap to be attached to a front end portion of the present cartridge type feeding container and a cap to be attached to a rear end portion of the present cartridge type feeding apparatus will be omitted for convenience of explanation.

In the present embodiment, the cartridge type feeding container is structured, for example, such as to be used for the purpose of appropriately feeding a stick-shaped cosmetic material installed in a cartridge together with a core chuck by a user.

Further, the cartridge type feeding container is constituted, as shown in FIG. 1, by a main body 1, a lid body 2, a cartridge 3, a feeding and drawing mechanism 4, projections 5, an intermediate device 6 and vertical ribs 7.

A description will be in detail given below of each of the constituting elements.

(1) Main Body 1

The main body 1 is structured such as to be formed in a tubular shape (refer to FIGS. 1 and 2).

Specifically, as shown in FIG. 2, the main body 1 is open toward a front side (a left side in the drawing), and a cosmetic material 81 is received in an inner portion thereof.

In this case, the cosmetic material 81 includes a powdery material, a material obtained by pressing fine particles, a liquid material and others in various states. Specifically, an eyeliner, an eye shadow, a lip stick, a manicure, a pedicure and the like can be exemplified.

In the present embodiment, the main body 1 is structured, as shown in the drawing, such as to be provided with an outer tube 11 which is open toward a front side, an inner tube 12 which is provided within the outer tube so as to be slidable in a longitudinal direction, has a cosmetic material received in an inner portion thereof, and is open toward a front side, and a coil spring 13 corresponding to an elastic body which is received within the outer tube 11, and is provided for energizing the inner tube 12 toward a front side.

In other words, the main body 1 is structured, as shown in FIG. 1, such that the inner tube 12 is energized toward the front side by the elastic body, whereby the cosmetic material received within the inner tube 12 is pressed to an applicator 21 of the lid body 2 attached to the main body 1.

In this case, the main body 1 is structured such that a coil brush 14 is provided in a rear end portion so as to protrude toward a rear side, whereby a user's convenience is intended.

(2) Lid Body 2

The lid body 2 is structured, as shown in FIG. 3, such that the applicator 21 having an applying member 21*a* in a rear end portion is provided so as to protrude toward a rear side (a right side in the drawing), and is attached to the main body 1 so as to insert the applicator 21 into the main body 1, as shown in FIG. 1.

Further, the lid body 2 is open toward a front side, as shown in FIG. 3, and the rear side is inserted into the lid body 2 through the opening as shown in FIG. 1, whereby it is possible to connect the cartridge 3.

In this case, a screwing means is employed as a connecting means of the outer tube 11 and the lid body 2, however, the connecting means is not limited to this, and a fitting means and the other means can be appropriately selected and used.

As for the applying member 21*a* of the applicator 21, a structure made of a porous material having a good holding performance of the fine particle or the liquid cosmetic material, for example, felt, foamed plastic and foamed rubber (NBR or the like), a structure obtained by binding a nylon fiber to an elastomer resin serving as a core material, or a structure obtained by bundling polyester fibers can be employed.

As for, a shape of the applicator 21, a pen point or an ink brush point shape in which a diameter becomes smaller gradually toward a leading end can be employed, whereby an excellent use feeling can be expected.

(3) Cartridge 3

The cartridge 3 is structured, as shown in FIG. 4, such that a core chuck 31*a* for holding the stick-shaped cosmetic material 82 is received so as to be slidable in a longitudinal direction, and is connected to the lid body 2 so as to be inserted into the lid body 2 in a rear side, as shown in FIG. 1.

In this case, the core chuck 31*a* has a male screw 31*b* formed in an outer portion as shown in FIG. 4, and is formed in a front end portion of a screw rod 31 mentioned below received within the cartridge 3.

Specifically, the cartridge 3 is constituted, as shown in the drawing, by the screw rod 31 having a core chuck 31*a*, a tubular sleeve 32 corresponding to a front side, and a tubular intermediate body 33 in which a front side is inserted into a rear side of the sleeve 32 so as to be lapped, thereby forming a rear side connected so as to be rotatable around an axis.

(4) Feeding and Drawing Mechanism 4

The feeding and drawing mechanism 4 is structured to play a role in feeding the core chuck 31*a* to a front end side of the cartridge 3 and drawing to a rear end side.

Specifically, the feeding and drawing mechanism 4 is structured, as shown in FIGS. 1 and 4, such as to be provided with a connecting means 41 connecting the sleeve 32 and the intermediate body 33 so as to be relatively rotatable around an axis by inserting the front side of the intermediate body 33 into the rear side of the sleeve 32 so as to be lapped, a synchronous rotating means 42 interposed between the rotatably connected intermediate body 33 and lid body 2 and synchronously rotating them, the synchronous rotating means being constituted by a first vertical rib 71 and a second vertical rib 72, a screw rod 43 received within the cartridge 3, having the core chuck 31*a* formed in a front end portion thereof, and having the male screw 31*b* formed in an outer portion thereof, a support portion 44 formed in an inner portion of the sleeve 32 and supporting the core chuck 31*a* so as not to rotate and so as to freely slide, and a female thread 45 formed in an inner portion of the intermediate body 33 and with which the male screw 31*b* of the screw rod 31 is engaged.

In this case, the male screw 31*b* and the female thread 45 described here are concepts respectively including thread-like projection 5 and groove having the same functions.

(5) Projection 5

The projection 5 is structured, as shown in FIGS. 5 and 6, such as to be constituted by first stage projections 51 formed approximately in a V shape in a side view, second stage projections 52 having the same shape, and a locking projection 53.

The first stage projections 51 are structured such as to be provided so as to protrude toward an inner side from an inner peripheral surface of the main body 1 (refer to these drawings).

The first stage projections 51 are structured, as shown in FIG. 5, as a projection group in which a plurality of projections are intermittently arranged along a peripheral direction.

In this case, each of the first stage projections 51 is formed approximately in a V shape in a side view as shown in FIGS. 5 and 6, and has a recess portion 51*a* in which a rear side is depressed.

In other words, each of the first stage projections 51 has a top portion 51*b* formed in a chevron shape in which a width is narrowed toward a front side in a side view, and an inclined portion 51*c* bifurcated toward right and left rear sides from the top portion 51*b* so as to be formed in an inclined band shape.

The first stage projection 51 is not limited to the structure provided in the inner peripheral surface of the main body 1, but may be provided in the outer peripheral surface of the applicator 21, or may be provided in both of the inner peripheral surface of the main body 1 and the outer peripheral surface of the applicator 21. In this case, it is necessary that the locking projection 53 is provided so as to oppose to the first stage projection 51, and it is necessary that the locking projection 53 is provided in the surface opposing to the surface provided with the first stage projection 51.

Further, the second stage projections 52 are structured such as to be provided so as to protrude toward an inner side from the inner peripheral surface of the main body 1 (refer to these drawings).

The second stage projections 52 are structured, as shown in FIG. 5, as a projection group in which a plurality of projections are arranged intermittently along a peripheral direction at positions which are adjacent to the rear side of the first stage projections 51 and correspond to gaps 91 between the adjacent first stage projections 51.

In this case, each of the second stage projections 52 is formed approximately in a V shape in a side view as shown in FIGS. 5 and 6, and has a recess portion 51*a* in which a rear side is depressed.

In other words, each of the second stage projections 52 has a top portion 51*b* formed in a chevron shape in which a width is narrowed toward a front side in a side view, and an inclined portion 51*c* bifurcated toward right and left rear sides from the top portion 51*b* so as to be formed in an inclined band shape.

The second stage projection 52 is not limited to the structure provided in the inner peripheral surface of the main body 1, but may be provided in the outer peripheral surface of the applicator 21, or may be provided in both of the inner peripheral surface of the main body 1 and the outer peripheral surface of the applicator 21. In this case, it is necessary that the locking projection 53 is provided so as to oppose to the second stage projection 52, and it is necessary that the locking projection 53 is provided in the surface opposing to the surface provided with the second stage projection 52.

On the other hand, the locking projection 53 is structured such as to be provided so as to protrude toward an outer side from the outer peripheral surface of the applicator 21 in which the first stage projections 51 and the second stage projections 52 are not provided (refer to FIG. 5).

The locking projection 53 is structured, as shown in the drawing, such as to pass through the gap 91 between the projections 5 which are adjacent in a lateral direction at a time when the lid body 2 is attached to the main body 1.

As for the locking projection 53, a shape and a number thereof are not limited, as far as the locking projection 53 can pass through the gap 91 between the projections 5 adjacent in the lateral direction at a time of attaching the lid body 2 to the main body 1, and can be locked by the recess portion 51*a* and the recess portion 52*a* of the respective projections 5 at a time of detaching the lid body 2 from the main body 1. However, it is preferable that a plurality of locking projections are provided, in view of securing the lock of the lid body 2 and the main body 1.

The locking projection 53 is not limited to be provided in the outer peripheral surface of the applicator 21, but may be appropriately set at the position opposing to the first stage projections 51 or the second stage projections 52. For example, the locking projection may be provided in the inner peripheral surface of the main body 1, or may be provided in both of the inner peripheral surface of the main body 1 and the outer peripheral surface of the applicator 21. In this case, it is necessary that the first stage projections 51 and the second stage projections 52 are provided so as to oppose to the locking projection 53, and it is necessary that the first stage projections 51 and the second stage projections 52 are provided in the surface opposing to the surface in which the locking projection 53 is provided.

(6) Intermediate Device 6

The intermediate device 6 is structured, as shown in FIG. 1, such as to be interposed between the cartridge 3 and the lid body 2 (refer to FIG. 3).

The intermediate device 6 is a tubular elastic body cushioning an impact applied in a direction in which the cartridge 3 protrudes, as shown in FIG. 7.

In accordance with the intermediate device 6 mentioned above, it is possible to further add a function capable of cushioning the impact on the basis of an external force such as a drop to the floor or the like, whereby it is possible to obtain an effect of preventing the cartridge 3 from falling out from the lid body 2, the stick-shaped cosmetic material 82 from being damaged, and the stick-shaped cosmetic material 82 from falling out from the core chuck 31*a*.

Specifically, the intermediate device 6 is made of a resin as shown in the drawing, and is structured such as to have a slit 61 which is spirally notched on the outer peripheral wall.

In this case, when a compression force is applied to the intermediate device 6 in a longitudinal direction, a width of the slit 61 is narrowed in a longitudinal direction, whereby the intermediate device 6 is compressed in the longitudinal direction with a considerable reliability (refer to the drawing).

In other words, in accordance with the intermediate device 6 mentioned above, it is possible to effectively prevent an unexpected matter in which the cushioning function of the impact due to the external force can not be sufficiently achieved from being generated, so that it is possible to secure the effect of preventing the cartridge 3 from falling out from the lid body 2, the stick-shaped cosmetic material 82 from being damaged, and the stick-shaped cosmetic material 82 from falling out from the core chuck 31*a*.

(7) Vertical Rib 7

The vertical rib 7 is structured, as shown in FIGS. 8 and 9, such as to be constituted by first vertical ribs 71 and second vertical ribs 72.

The first vertical ribs 71 are structured, as shown in the drawings, such that each of them protrudes toward an outer side and extends in a longitudinal direction, in an outer periphery of a rear end portion of the intermediate body 33, and a plurality of the vertical ribs are intermittently arranged along a peripheral direction.

On the other hand, the second vertical ribs 72 are structured, as shown in the drawings, such that each of them protrudes toward an inner side and extends in a longitudinal direction, in an inner periphery of the opening portion of the lid body 2, and a plurality of the vertical ribs are intermittently arranged along a peripheral direction.

In other words, in accordance with the vertical rib 7 mentioned above, it is possible to synchronously rotate the main body 1 and the intermediate body 33 by connecting the cartridge 3 to the lid body 2 so as to engage the first vertical ribs 71 and the second vertical ribs 72 with each other.

The second vertical rib 72 has an inclined surface 72*a* with which an end portion of the first vertical rib 71 positioned at a position adjacent in the peripheral direction at a time of the synchronous rotation is brought into contact, as shown in the drawings.

In accordance with the vertical rib 7 mentioned above, when an excessive torque is applied to the screw rod 31, the first vertical rib 71 brought into contact with the inclined surface 72*a* can climb over the second vertical rib 72 having the inclined surface 72*a* on the basis of the contraction of the intermediate device 6.

In other words, a torque limiter can be provided with respect to the synchronous rotation of the main body 1 and the intermediate body 33, whereby it is possible to avoid a situation that the container is damaged due to an excessive torque.

The inclined surface is not limited to be provided in a side of the second vertical rib 72, but may be provided in a side of the first vertical rib 71. In this case, it is necessary that an end portion of the second vertical rib 72 positioned at a position adjacent in the peripheral direction at a time of the synchronous rotation is brought into contact with the inclined surface provided in the first vertical rib 71.

As mentioned above, the cartridge type feeding container in accordance with the present embodiment is structured such that the first stage projections 51 and the second stage projections 52 are provided in the inner peripheral surface of the main body 1, and the locking projection 53 is provided in the outer peripheral surface of the applicator 21.

Therefore, in accordance with the cartridge type feeding container as mentioned above, even if the lid body 2 or the main body 1 is slipped off a user's hand by accident, it is possible to prevent the lid body 2 or the main body 1 from jumping out from the main body 1 or the lid body 2.

Therefore, in accordance with this structure, it is possible to prevent dirt from being attached to the applying member 21*a*, the cosmetic material from being scattered to the floor or the like, and the lid body 2 or the main body 1 from being broken.

In particular, even in the case that the main body 1 has the mechanism in which the inner tube 12 is energized toward the front side by the elastic body and the lid body 2 or the main body 1 easily jumps out from the main body 1 or the lid body 2 with the lid body 2 or the main body 1 being held by the user's hand, as in the present embodiment, it is possible to securely prevent a situation that the lid body 2 or the main body 1 jumps out from the main body 1 or the lid body 2, in accordance with the cartridge type feeding container. Accordingly, it is possible to secure the effect of preventing dirt from being attached to the applying member 21*a*, the cosmetic material from being scattered to the floor or the like, and the lid body 2 or the main body 1 from being broken.

What is claimed is:

1. A cartridge type feeding container comprising:

a tubular main body open to a front side, and receiving a cosmetic material in an inner portion thereof;

a lid body open toward a front side and provided with an applicator having an applying member protruding toward a rear side, the lid body being attached to the main body in such a manner as to insert the applicator into the main body;

a cartridge receiving a core chuck for holding a stick-shaped cosmetic material so as to be slidable in a longitudinal direction, the core chuck being connected to the lid body in such a maimer as to insert a rear side thereof into said lid body; and a feeding and drawing mechanism for feeding said core chuck to a front end side of said cartridge and drawing the core chuck to a rear end side of said cartridge;

wherein a plurality of first stage projections are provided on an inner peripheral surface of said main body or on an outer peripheral surface of the applicator along a peripheral direction, a plurality of second stage projections are provided along the peripheral direction at positions which are on the inner peripheral surface of said main body or on the outer peripheral surface of the applicator, adjacent to rear sides of said first stage projections and corresponding to gaps between the adjacent first stage projections, each of said first stage and second stage projections being formed in an approximately V shape and having a top portion directed to a front side and an inclined portion inclined toward right and left rear sides respectively from the top portion, and at least one locking projection, which passes through a gap between respective adjacent projections in a lateral direction when said lid body is attached to the main body, are provided in the outer peripheral surface of said applicator or the inner peripheral surface of the main body where said first and second stage projections are not provided;

wherein said core chuck is formed in a front end portion of a screw rod which has a male screw thread formed in an outer portion, and is received within said cartridge, said cartridge being constituted by a sleeve corresponding to a front side thereof in which a support portion, supporting said core chuck so as not to rotate and so as to be slidable, is formed in an inner portion, and an intermediate body corresponding to a rear side of the cartridge in which a female thread engaging with said male screw is formed in an inner portion;

a plurality of first vertical ribs each protruding to an outer side and extending in a longitudinal direction are formed in an outer periphery of a rear end portion of said intermediate body along a peripheral direction;

a plurality of second vertical ribs each protruding to an inner side and extending in the longitudinal direction are formed in an inner periphery of an opening portion of said lid body along the peripheral direction;

said cartridge connected to said lid body to engage said first vertical rib and the second vertical rib with each other, thereby allowing said main body and the intermediate body to synchronously rotate;

said first vertical rib or said second vertical rib having an inclined surface in which an end portion is inclined toward a front left side or a front right side;

wherein end portions of said adjacent second vertical ribs or first vertical ribs are brought into contact during said synchronous rotation;

an intermediate device corresponding to a tubular elastic body is interposed between said cartridge and the lid body for buffering an impact applied in a direction in which the cartridge protrudes out;

and said intermediate device being contracted when an excessive torque is applied to said screw rod, whereby said second vertical rib or said first vertical rib brought into contact with the inclined surface climbs over the other of said first vertical rib or said second vertical rib having the inclined surface.

2. A cartridge type feeding container according to claim 1, wherein said main body is provided with an outer tube open toward a front side, an inner tube provided within the outer tube so as to be slidable in a longitudinal direction, having the cosmetic material received in an inner portion thereof, and being open toward a front side;

an elastic body received within said outer tube and provided for biasing said inner tube toward a front side, and said inner tube being biased toward the front side by the elastic body;

whereby the cosmetic material received within the inner tube is pressed into contact with the applicator of the lid body attached to said main body.

3. A cartridge type feeding container according to claim 1, wherein said intermediate body is made of resin, and has a slit which is spirally notched on an outer peripheral wall thereof.

* * * * *